US009945239B2

(12) United States Patent
Przybyl et al.

(10) Patent No.: US 9,945,239 B2
(45) Date of Patent: Apr. 17, 2018

(54) VANE CARRIER FOR A COMPRESSOR OR A TURBINE SECTION OF AN AXIAL TURBO MACHINE

(71) Applicant: ANSALDO ENERGIA IP UK LIMITED, London (GB)

(72) Inventors: Robert Przybyl, Würenlingen (CH); Oliver Joseph Taheny, Zürich (CH); Giovanni Cataldi, Zürich (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 215 days.

(21) Appl. No.: 14/680,292

(22) Filed: Apr. 7, 2015

(65) Prior Publication Data

US 2015/0292341 A1 Oct. 15, 2015

(30) Foreign Application Priority Data

Apr. 9, 2014 (EP) ..... 14164014

(51) Int. Cl.
*F01D 9/04* (2006.01)
*F01D 11/00* (2006.01)
(Continued)

(52) U.S. Cl.
CPC ..... *F01D 9/04* (2013.01); *F01D 9/041* (2013.01); *F01D 9/042* (2013.01); *F01D 11/005* (2013.01); *F01D 11/18* (2013.01); *F01D 25/246* (2013.01); *F01D 25/265* (2013.01); *F04D 29/541* (2013.01); *F05D 2220/31* (2013.01);
(Continued)

(58) Field of Classification Search
CPC . F01D 9/04; F01D 11/00; F01D 11/18; F01D 25/265; F01D 9/041; F01D 9/042; F04D 27/02; F04D 29/541
See application file for complete search history.

(56) References Cited

U.S. PATENT DOCUMENTS 4,915,581 A * 4/1990 Groenendaal, Jr. ... F01D 25/007 248/901
5,459,995 A 10/1995 Norton et al.
(Continued)

FOREIGN PATENT DOCUMENTS

| | | |
|---|---|---|
| DE | 10 2008 033400 A1 | 1/2010 |
| EP | 1 793 092 A1 | 6/2007 |
| WO | 2010/023150 A1 | 3/2010 |

*Primary Examiner* — Woody Lee, Jr.
*Assistant Examiner* — Maxime Adjagbe
(74) *Attorney, Agent, or Firm* — Buchanan Ingersoll & Rooney PC

(57) ABSTRACT

A vane carrier is provided for a compressor or a turbine section of an axial turbo machine, especially one of a gas turbine, steam turbine, compressor, expander, comprises least a first and second functional means. The first functional means is a cylinder made of a material with a coefficient of thermal expansion (CTE) below $1.3\times10^{-5}$ [1/K]. The cylinder is provided for carrying a plurality of vanes on its inner side. The second functional means is a support structure made of a material different to and less expensive than the material of said first functional means. The support structure is provided for defining an axial and lateral position of the first functional means within an outer casing of the axial turbo machine.

10 Claims, 2 Drawing Sheets

(51) Int. Cl.

| | |
|---|---|
| ***F01D 11/18*** | (2006.01) |
| ***F01D 25/24*** | (2006.01) |
| ***F01D 25/26*** | (2006.01) |
| ***F04D 29/54*** | (2006.01) |

(52) U.S. Cl.
CPC ..... *F05D 2220/32* (2013.01); *F05D 2230/90* (2013.01); *F05D 2240/12* (2013.01); *F05D 2240/14* (2013.01); *F05D 2300/171* (2013.01); *F05D 2300/502* (2013.01); *F05D 2300/50212* (2013.01)

(56) References Cited

U.S. PATENT DOCUMENTS

| | | | | |
|---|---|---|---|---|
| 7,686,575 | B2 * | 3/2010 | Chehab | F01D 11/18 29/889.22 |
| 7,722,318 | B2 * | 5/2010 | Addis | B23P 6/005 415/148 |
| 2010/0031671 | A1 | 2/2010 | Chehab et al. | |
| 2012/0045312 | A1 | 2/2012 | Kimmel et al. | |
| 2013/0004306 | A1 * | 1/2013 | Albers | F01D 25/246 415/200 |

* cited by examiner

VANE CARRIER FOR A COMPRESSOR OR A TURBINE SECTION OF AN AXIAL TURBO MACHINE

CROSS-REFERENCE TO RELATED APPLICATIONS

This application claims priority to European application 14164014.4 filed Apr. 9, 2014, the contents of which are hereby incorporated in its entirety.

TECHNICAL FIELD

The present invention relates to the technology of turbo machines. It refers to a vane carrier for a compressor or a turbine section of an axial turbo machine according to the preamble of claim 1.

BACKGROUND

Gas turbines usually comprise a compressor section, a combustor and at least one turbine. Within the compressor section alternating rows of running blades and guiding vanes interact with the combustion air as it is compressed in an annular gas channel to be used in the combustor for burning a fuel. While the running blades are mounted on a central rotor, the guiding vanes are stationary and mounted on suitable compressor vane carriers (CVCs), which concentrically surround and border the gas channel.

It is well-known in the prior art to use CVCs completely made of low thermal expansion material, e.g. a Ni-base alloy. When applied to an industrial (stationary) gas turbine (GT) of, for example, 50 MW power, this design is advantageous, because it brings a high clearance reduction and thus improves the overall efficiency of the machine. However, it is extremely expensive for a large GT to have a CVC, which is completely made of low thermal expansion material.

It has therefore already been proposed to use a hybrid design of the CVC, where the cylindrical part is made of several segments made of standard, low alloyed steel and the supporting structure, which is defining the clearances, made of low thermal expansion material (see document US 2012/0045312 A1). This solution has its disadvantages, because the segmented, cylindrical part is assumed to be prone to significant thermal distortions. This is because the segments are relatively long and do not support each other. Also, the longitudinal gaps between the segments could be a source of excitation for the compressor blading.

Document WO 2010023150 A1 relates to a guide vane support for an axial-flow, stationary gas turbine, comprising a tubular wall with an inflow-side end and an outflow-side end opposite the inflow-side end for fluid flowing within the guide vane support in a flow path of the gas turbine, wherein at least one cooling channel for a coolant is provided in the wall. In order to provide a guide vane support that is suitable for especially high operating temperatures and that can nevertheless be manufactured comparatively inexpensively, it is proposed that the turbine vane support be designed in multi-layered fashion—as seen in the radial direction. The different layers of the guide vane support can be connected together using hot isostatic pressing, wherein the inner layers of the guide vane support can be manufactured from a high-temperature resistant material, whereas the exterior layers of the guide vane support can be manufactured from a less temperature resistant material. Also, by designing the guide vane support in multi-layered fashion, it is very easy to manufacture cooling channels inside the wall of the guide vane support. Although the use of expensive high temperature material is reduced, the manufacturing of the multi-layer elements is still expensive and time-consuming.

SUMMARY

It is an object of the present invention to provide a CVC, which is easy to manufacture, less expensive and reduces the compressor running clearances while keeping same pinch point clearances, i.e. causes a performance increase while keeping same rubbing risk.

This and other objects are obtained by a vane carrier according to claim 1.

The vane carrier according to the invention is provided for a compressor or a turbine section of an axial turbo machine, especially one of a gas turbine, steam turbine, compressor, and expander. Said vane carrier comprises least a first and second functional means, whereby said first functional means is a cylinder made of a material with a coefficient of thermal expansion (CTE) below $1.3\times10^{-5}$ [1/K], which cylinder is provided for carrying a plurality of vanes on its inner side, and whereby said second functional means is a support structure made of a material different to and less expensive than the material of said first functional means, which support structure is provided for defining an axial and lateral position of said first functional means within an outer casing of said axial turbo machine.

According to an embodiment of the invention said cylinder is split at a split plane and consists of two or more cylindrical parts, which are connected together.

Specifically, said split plane is a horizontal or vertical or general axial plane.

Specifically, said cylindrical parts are connected together by bolts or pins.

According to another embodiment of the invention said support structure comprises a plurality of support segments, said support segments being radially fixed to said first functional means.

Specifically, there is a gap between each pair of neighbouring support segments, and sealing elements are provided for closing said gaps.

According to just another embodiment of the invention said support structure is ring-shaped and disposed between said first functional means and said outer casing such that it is free to expand radially and gives axial support to the first functional means within said outer casing.

According to a further embodiment of the invention said first functional means is coated on its inner side with a coating layer.

Specifically, said coating layer comprises an abradable or oxidation resistance coating.

According to another embodiment of the invention the material of said first functional means is Incoloy® 907/909 or INVAR®.

According to just another embodiment of the invention the material of said second functional means is standard, low alloyed steel.

BRIEF DESCRIPTION OF THE DRAWINGS

The present invention is now to be explained more closely by means of different embodiments and with reference to the attached drawings.

DETAILED DESCRIPTION

Low thermal expansion (low CTE) materials bring significant benefit in the reduction of the compressor clearances. Unfortunately, these materials are only very expensive nickel-alloyed steels. The hybrid design of a vane carrier according to the present invention allows application of low thermal expansion materials for the main cylindrical part of the carrier, while the less critical supporting and sealing structure is made of standard, less expensive steel.

Two designs are proposed with the same principle of using low thermal expansion material for the cylindrical part and standard low-alloyed steel for the supporting part of the vane carrier.

Figure 1:
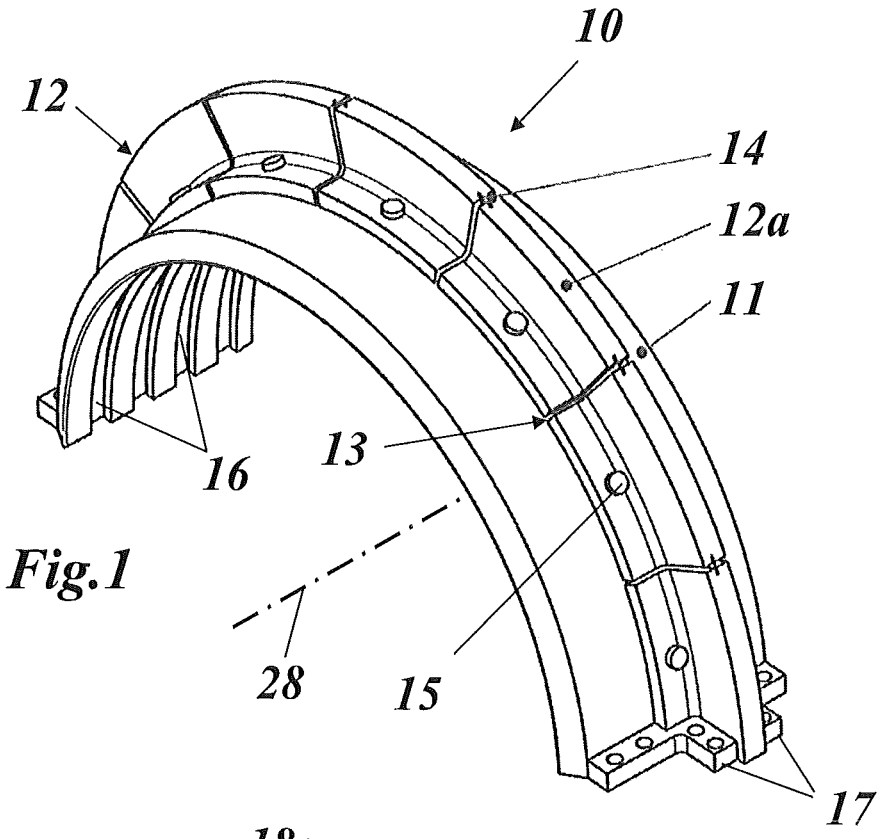
FIG. 1 shows a perspective view of a compressor vane carrier according to a first embodiment of the invention.
Figure 2:
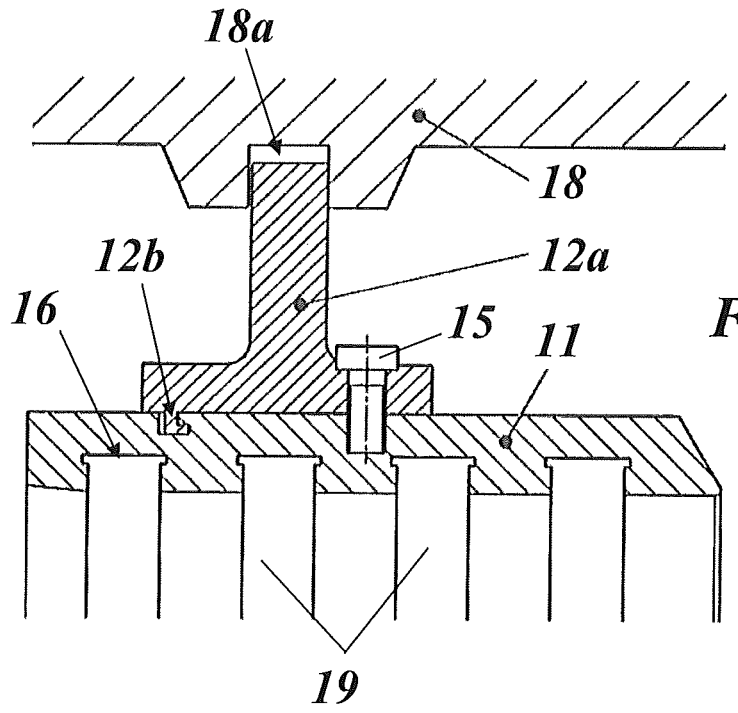
FIG. 2 shows a sectional view of an axial section of the compressor vane carrier according to FIG. 1.
Figure 3:
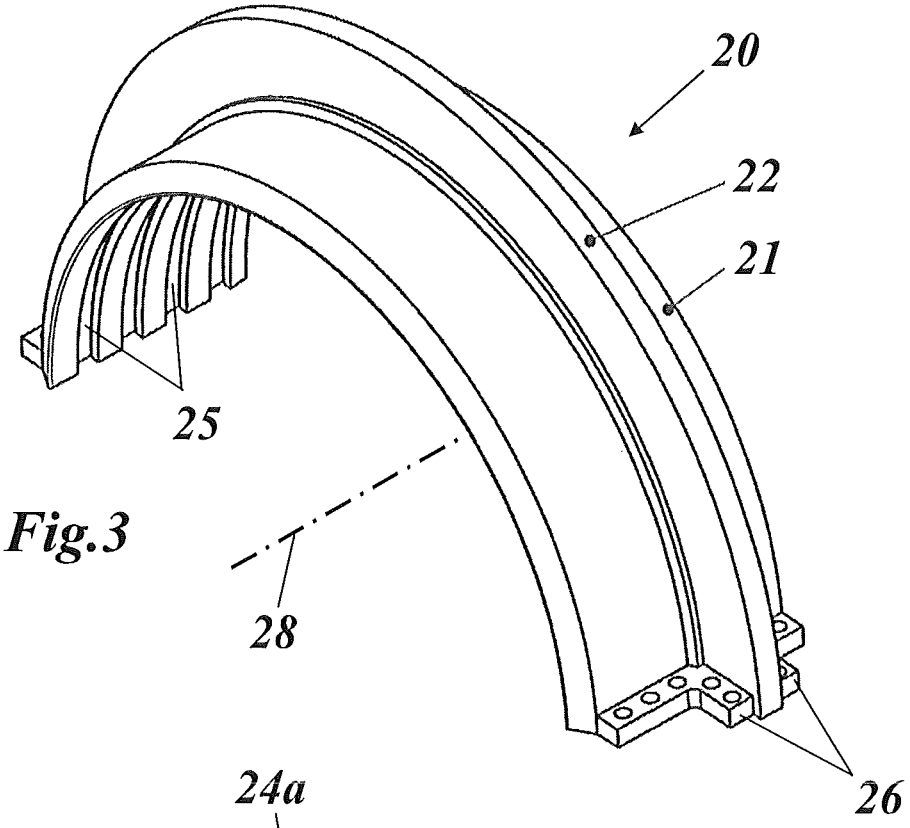
FIG. 3 shows a perspective view of a compressor vane carrier according to a second embodiment of the invention.
Figure 4:
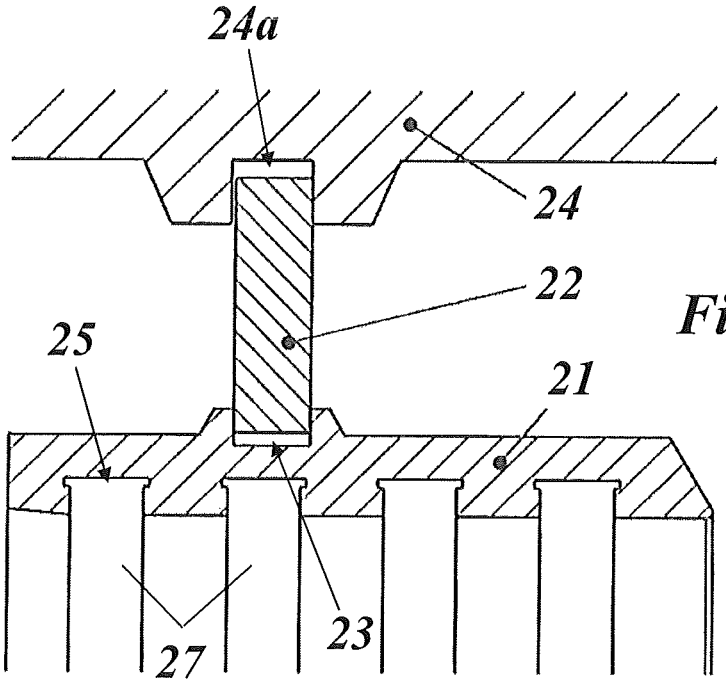
FIG. 4 shows a sectional view of an axial section of the compressor vane carrier according to FIG. 3.

In both designs, as shown in FIGS. 1 and 2 (first design), and FIGS. 3 and 4 (second design) the cylindrical part 11 and 21, respectively, of the vane carrier 10 and 20, respectively, is made of low thermal expansion material to reduce the running clearances of the compressor. Purpose of this cylindrical part 11, 21 is to define the (annular) compressor channel geometry with regard to the machine axis 28, define clearances above the compressor blades (not shown), and to carry the compressor vanes 19 and 27, respectively. It also contains vertical split plane flanges 17 and 26, respectively, with its bolting. The vane carriers 10, 20 are positioned in an outer casing (18 in FIG. 2; 24 in FIG. 4) by means of support structures 12 and 22, respectively.

Possible materials with low coefficient of thermal expansion (CTE) are: Incoloy® 907/909 and INVAR® or any other material with CTE<$1.3\times10^{-5}$ [1/K]. In both designs, the support structure 12 and support ring 22, respectively, is made of standard, low alloyed steel.

The purpose of the support structure 12 and support ring 22, respectively, is the definition of the axial and lateral positions of the vane carrier 10 and 20, and its cylindrical part 11 and 21, respectively, within the outer casing 18 and 24, respectively. At the same time, the support structure 12 and support ring 22 provide a sealing between two axially separated compressor extraction air cavities.

In the first design (FIGS. 1 and 2), the support section or support structure 12 (axial flange) is built in a form of several segments 12*a* with sealing elements 14 to close the gaps 13 between adjacent segments 12*a*. The segmented design of the support structure 12 allows free thermal expansion of the cylindrical part 11 made of low thermal expansion material. Support segments 12*a* are each mounted on the outer side of cylindrical part 11 by means of a hook 12*b* and bolt 15. On the inner side of the cylindrical part 11 a plurality of circumferential vane grooves 16 are provided for receiving the vanes 19. With their outer ends support segments 12*a* mesh with a support groove 18*a* on the inner side of outer casing 18. Two such cylindrical parts are joined together in a split plane by means of split plane flanges 17.

In the second design (FIGS. 3 and 4), the axial flange or support ring 22 is not fixed to the cylindrical part 21 of the carrier 20. Instead, it is designed as an independent ring (split at the engine split plane) free to expand radially (see FIG. 4) and thick enough to give an axial support to the cylindrical part 21 of the carrier 20 made of low thermal expansion material. Support ring 22 is held in two support grooves 23 and 24*a* with a degree of freedom to expand radially while at the same time giving axial support to the vane carrier 20. Again, circumferential vane grooves 25 are provided on the inner side of cylindrical part 21 to receive vanes 27.

In both cases (FIGS. 1 and 3) cylindrical part 11 or 21, respectively, can be coated on its inner side in various ways (e.g. abradable coating, oxidation resistance coatings, other suitable coatings) in order to overcome typical limits of materials with low coefficient of thermal expansion (CTE) and adapt the part to the particular application.

Furthermore, cylindrical part 11 or 21, respectively, can be specifically designed to carry (upstream or downstream or between the vanes) heat shields or other subparts (not shown in the Figures).

The design according to the present invention has the following advantages:

- Reduced compressor running clearances as in the case of a complete (expensive) casing made of low thermal expansion material;
- Significantly lower cost. The assumed cost of hybrid design is cost neutral. It means that the increase in the cost of a new design is fully covered by increase in the GT performance.

The present invention has been described in connection with gas turbines (GTs). However, it may be as well applied to other turbo machines, for example, steam turbines.

The invention claimed is:

1. A vane carrier for a compressor or a turbine section of an axial turbo machine, especially one of a gas turbine, steam turbine, compressor, expander, said vane carrier comprising:

first and second functional means, whereby said first functional means is a cylinder made of a material with a coefficient of thermal expansion (CTE) below $1.3\times10^{-5}$ [1/K], which cylinder is provided for carrying a plurality of vanes on its inner side, and whereby said second functional means is a support structure made of a material different from and less expensive than the material of said first functional means, which support structure is provided for defining an axial and lateral position of said first functional means within an outer casing of said axial turbo machine, wherein said cylinder is split at a split plane and includes two or more cylindrical parts, which are connected together, and wherein said support structure includes a plurality of support segments on each cylindrical part of said first functional means, said support segments being radially fixed to said first functional means.

2. The vane carrier as claimed in claim 1, wherein said split plane is a horizontal or vertical or general axial plane.

3. The vane carrier as claimed in claim 1, wherein said cylindrical parts are connected together by bolts or pins.

4. The vane carrier as claimed in claim 1, wherein there is a gap between each pair of neighbouring support segments, and sealing elements are provided for closing said gaps.

5. A vane carrier, for a compressor or a turbine section of an axial turbo machine, especially one of a gas turbine, steam turbine, compressor, and expander, said vane carrier comprising:

first and second functional means, wherein said first functional means is a cylinder made of a material with a coefficient of thermal expansion (CTE) below $1.3\times10^{-5}$ [1/K], which cylinder is provided for carrying a plurality of vanes on its inner side, and wherein said second functional means is a support structure made of a material different from the material of said first functional means, which support structure defines an axial and lateral position of said first functional means within an outer casing of said axial turbo machine, wherein said support structure is ring-shaped and disposed between said first functional means and said outer casing such that it is free to expand radially and gives axial support to the first functional means within said outer casing, and wherein said support structure is held by a first support groove on the first functional means and a second support groove on said outer casing.

6. The vane carrier as claimed in claim 1, wherein said first functional means is coated on its inner side with a coating layer.

7. The vane carrier as claimed in claim 6, wherein said coating layer comprises an abradable or oxidation resistance coating.

8. The vane carrier as claimed in claim 1, wherein the material of said first functional means is Incoloy® 907/909 or INVAR®.

9. The vane carrier as claimed in claim 1, wherein the material of said second functional means is a standard, low alloyed steel.

10. The vane carrier as claimed in claim 5, wherein the first and second support grooves are aligned along a radius of a machine axis.

* * * * *